US011525569B2

(12) United States Patent
Jacobson

(10) Patent No.: US 11,525,569 B2
(45) Date of Patent: Dec. 13, 2022

(54) PAINT APPLICATOR ASSEMBLY INCLUDING A LIGHT ASSEMBLY

(71) Applicant: Nova Wildcat Shur-Line, LLC, St. Francis, WI (US)

(72) Inventor: John Jacobson, Mequon, WI (US)

(73) Assignee: Nova Wildcat Shur-Line, LLC, St. Francis, WI (US)

( * ) Notice: Subject to any disclaimer, the term of this patent is extended or adjusted under 35 U.S.C. 154(b) by 0 days.

(21) Appl. No.: 17/026,988

(22) Filed: Sep. 21, 2020

(65) Prior Publication Data

US 2022/0090776 A1 Mar. 24, 2022

(51) Int. Cl.

| | |
|---|---|
| ***F21V 33/00*** | (2006.01) |
| ***B05C 1/00*** | (2006.01) |
| ***B05C 21/00*** | (2006.01) |
| ***B05C 17/00*** | (2006.01) |
| ***F21Y 105/00*** | (2016.01) |
| ***F21Y 115/10*** | (2016.01) |

(52) U.S. Cl.

CPC ..... *F21V 33/006* (2013.01); *B05C 1/006* (2013.01); *B05C 17/00* (2013.01); *B05C 21/00* (2013.01); *F21V 33/0084* (2013.01); *F21Y 2105/00* (2013.01); *F21Y 2115/10* (2016.08)

(58) Field of Classification Search

CPC .. F21V 33/006; F21V 33/008; F21V 33/0084; F21V 33/00; B05C 1/006; B05C 17/00; B05C 21/00; B44D 3/00

USPC ..... 362/96

See application file for complete search history.

(56) References Cited

U.S. PATENT DOCUMENTS

| | | | | |
|---|---|---|---|---|
| 5,250,139 | A * | 10/1993 | Hall | D06F 75/08 156/304.7 |
| 8,926,117 | B2 | 1/2015 | Blanchette | |
| 9,957,725 | B2 | 5/2018 | Maurer | |
| 2008/0311833 | A1 * | 12/2008 | King | B24B 23/00 451/356 |

(Continued)

FOREIGN PATENT DOCUMENTS

| | | |
|---|---|---|
| CN | 102164709 A | 8/2011 |
| CN | 202874312 U | 4/2013 |

(Continued)

OTHER PUBLICATIONS

Tacklife, "Handheld Drywall Sander", webpage:https://www.amazon.com/TACKLIFE-Handheld-Automatic-Electric-Collection/dp/B07WVHZ8V2/ref=pd_sbs_469_t_0/130-9004146-5995034?_encoding=UTF8 . . . , accessed Mar. 12, 2020 (13 Pages).

*Primary Examiner* — William N Harris

(74) *Attorney, Agent, or Firm* — Michael Best & Friedrich LLP

(57) ABSTRACT

A paint applicator assembly includes a frame having a base. The base has a forward side, a first lateral side, and a second lateral side opposite the first lateral side. A light assembly is supported by the frame. The light assembly includes a printed circuit board having a forward side portion positioned proximate the forward side of the base. The light assembly further includes a plurality of light sources supported on the printed circuit board. The plurality of light sources includes a first light source and a second light source positioned on the forward side portion. The first light source is configured to direct light along a first direction, and the second light source is configured to direct light along a second direction that is different than the first direction.

18 Claims, 10 Drawing Sheets

(56) References Cited

U.S. PATENT DOCUMENTS

| | | | | |
|---|---|---|---|---|
| 2009/0059569 | A1 | 3/2009 | Quattrini, Jr. | |
| 2010/0027246 | A1* | 2/2010 | Petersen | B24B 23/005 362/119 |
| 2016/0016193 | A1* | 1/2016 | Fee | B05C 17/00 401/48 |
| 2017/0066105 | A1 | 3/2017 | Grayden | |
| 2021/0244174 | A1* | 8/2021 | Kay | B05C 17/00 |

FOREIGN PATENT DOCUMENTS

| | | | |
|---|---|---|---|
| CN | 205654048 | U | 10/2016 |
| EP | 2653635 | A2 | 10/2013 |
| WO | 2019207532 | A1 | 10/2019 |

* cited by examiner

PAINT APPLICATOR ASSEMBLY INCLUDING A LIGHT ASSEMBLY

BACKGROUND

The present invention relates to a paint applicator assembly and, in particular, to a paint edger with a light assembly.

Paint edgers are used for wall painting, such as above baseboards, below crown molding, around window and door trim, and at the juncture between two walls. A paint applicator pad is typically coupled to a bottom side of the paint edger to apply paint to the wall or surface.

SUMMARY

In one embodiment, the invention provides a paint applicator assembly including a frame having a base. The base has a forward side, a first lateral side, and a second lateral side opposite the first lateral side. A light assembly is supported by the frame. The light assembly includes a printed circuit board having a forward side portion positioned proximate the forward side of the base. The light assembly further includes a plurality of light sources supported on the printed circuit board. The plurality of light sources includes a first light source and a second light source positioned on the forward side portion. The first light source is configured to direct light along a first direction, and the second light source is configured to direct light along a second direction that is different than the first direction.

In another embodiment, the invention provides a paint applicator assembly including a frame having a base. The base has a forward side, a first lateral side, and a second lateral side opposite the first lateral side. A light assembly is supported by the frame. The light assembly includes a plurality of light sources supported by the frame. The plurality of light sources includes a first light source, a second light source, and a third light source. The first light source is configured to direct light outward from the forward side of the base. The second light source is configured to direct light outward from the first lateral side of the base. The third light source is configured to direct light outward from the second lateral side of the base. The light assembly further includes a lens member configured to cover the plurality of light sources.

In another embodiment the invention provides a paint applicator assembly including a frame having a base. The base has a forward side, a first lateral side, and a second lateral side opposite the first lateral side. A light assembly is supported by the frame. The light assembly includes a printed circuit board having a forward side portion positioned proximate the forward side of the base. The light assembly also includes one or more light sources supported on the printed circuit board. A lens member is supported by the frame and configured to cover the one or more light sources. The lens member extends across the forward side and at least portions of the first lateral side and the second lateral side of the base.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
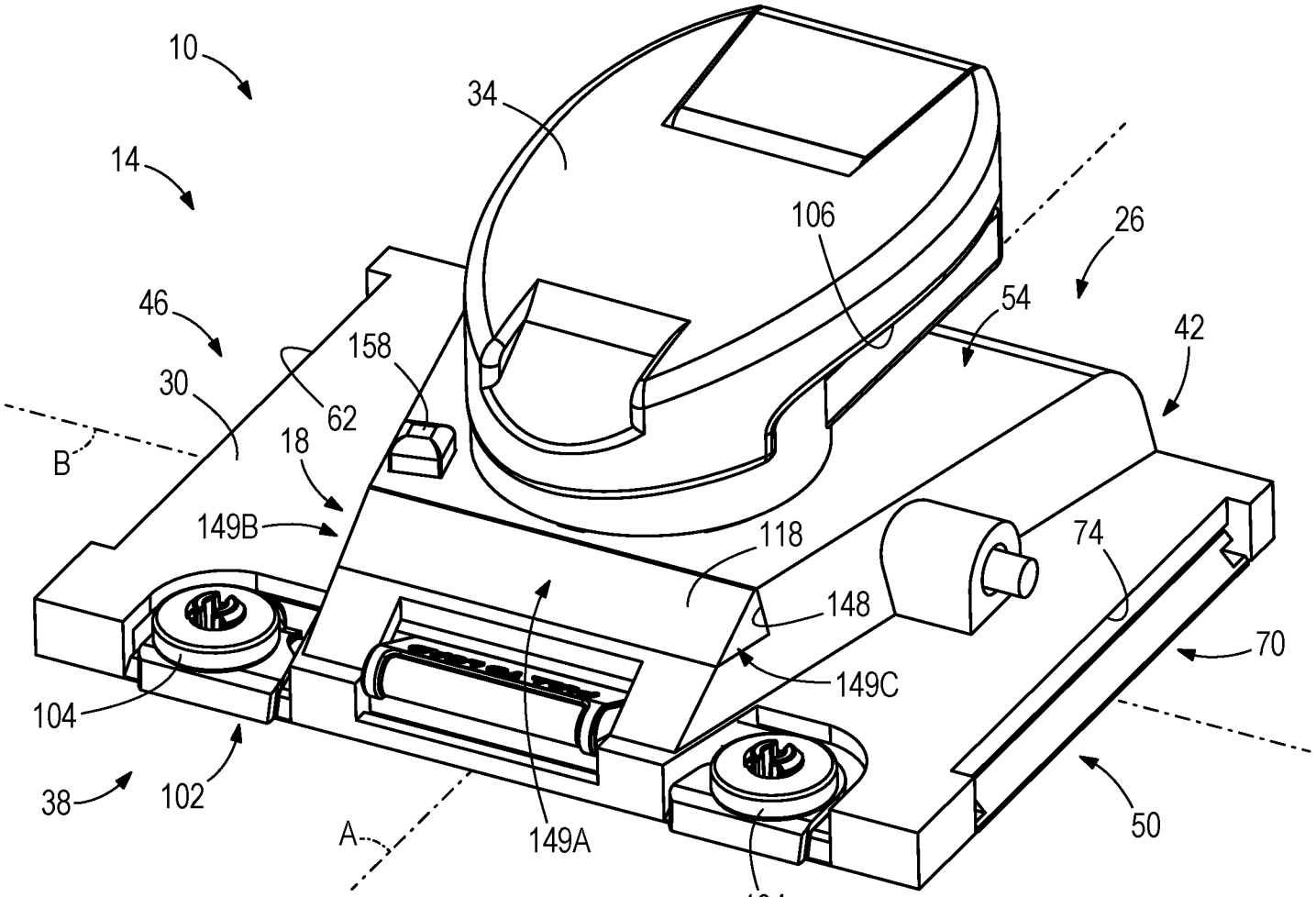
FIG. 1 is a front perspective view of a paint applicator assembly, including a paint edger and a light assembly.
Figure 2:
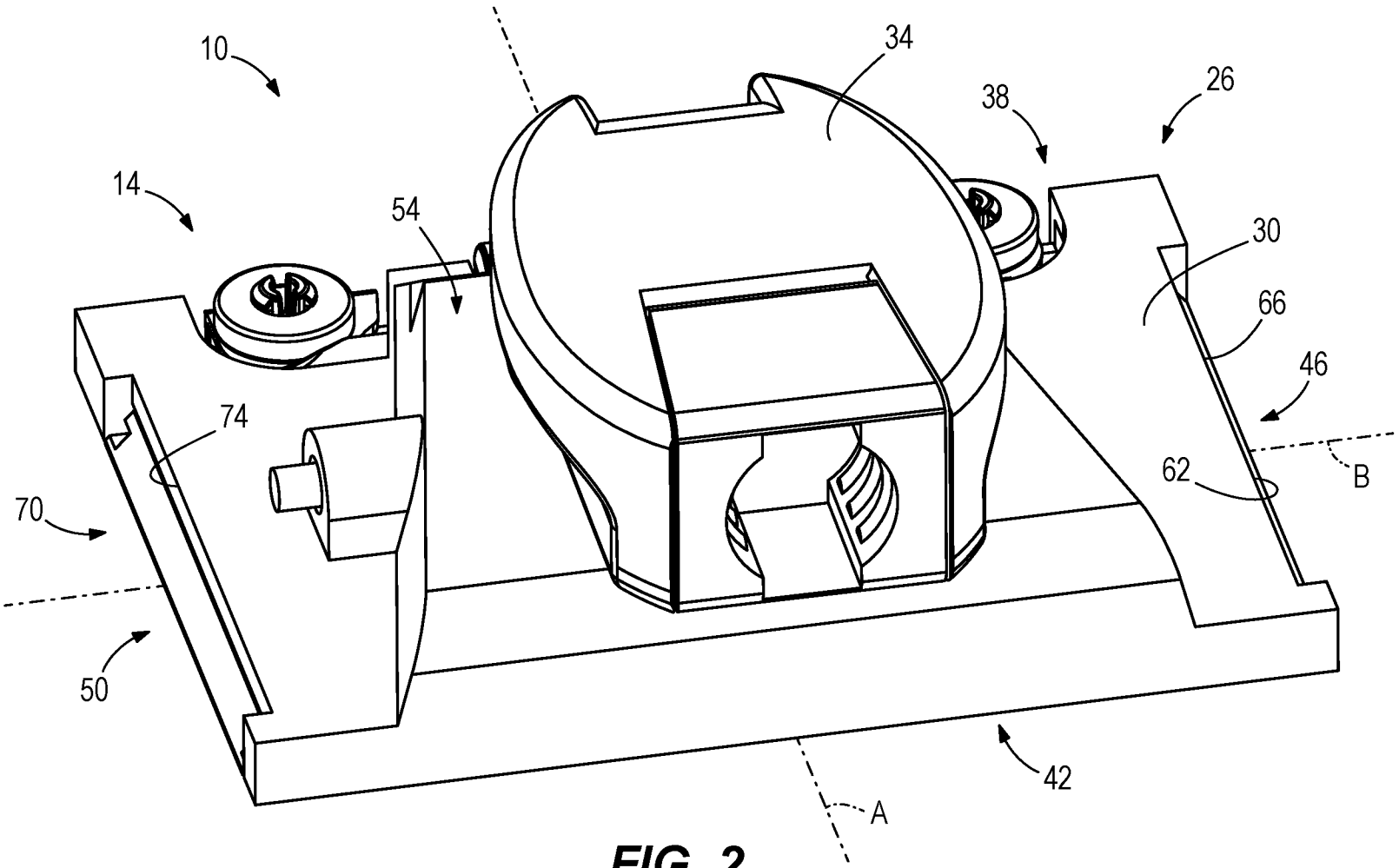
FIG. 2 is a rear perspective view of the paint applicator assembly of FIG. 1.

FIG. 1 illustrates a paint applicator assembly 10 including a paint edger 14 and a light assembly 18. The paint applicator assembly 10 further includes an applicator pad 22 (FIG. 5) for applying a liquid (e.g., paint, primer, stain, etc.) to a surface, such as an interior wall of a building. The illustrated paint applicator assembly 10 is particularly suited for painting corners, borders around windows or doorways, and between adjacent walls.

With reference to FIGS. 1-4, the paint edger 14 includes a frame 26. The frame 26 is a molded body that may be made by, for example, plastic injection molding. The frame 26 includes a base 30 and a turret 34. In the illustrated embodiment, the base 30 is generally rectangular in shape. In other embodiments, the base 30 may exhibit shapes other than rectangular such as, triangular, hexagonal, and T-shaped. The base 30 includes a forward side 38, a rear side 42, a first lateral side 46, a second lateral side 50 opposite the first lateral side 46, a top side 54, and a bottom side 58 opposite the top side 54.

The base 30 defines a longitudinal axis A extending through the forward side 38 and the rear side 42. The base 30 further defines a lateral axis B extending through the first lateral side 46 and the second lateral side 50. The longitudinal and lateral axes A, B are perpendicular to each other.

Figure 5:
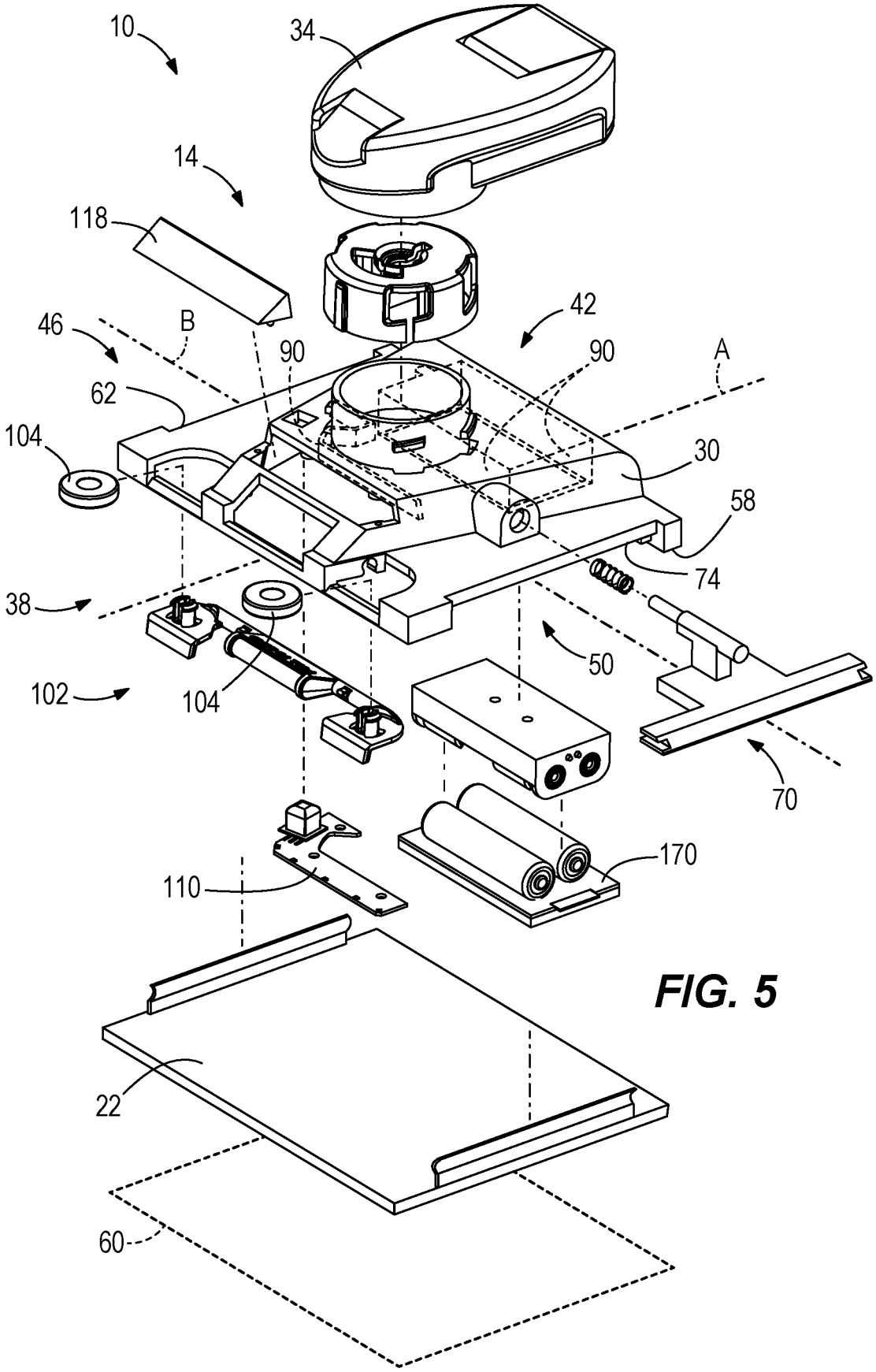
FIG. 5 is an exploded view of the paint applicator assembly of FIG. 1 with an applicator pad detached.

With reference to FIGS. 1 and 5, the base 30 defines a plane 60 (FIG. 5) that transverses the forward side 38, the rear side 42, the first lateral side 46, and the second lateral side 50. The plane 60 defines an area where the paint applicator pad 22 is coupled to the paint edger 14. The first lateral side 46 defines a first lateral recess 62. The first lateral recess 62 is defined by a first edge 66. The applicator pad 22 engages the first edge 66 when the applicator pad 22 is coupled to the paint edger 14. The second lateral side 50 defines a second lateral recess 74. An ejection mechanism 70 is partially positioned within the second lateral recess 74. The base 30 defines an interior 82 (FIG. 6) of the frame 22. The ejection mechanism 70 is also partially positioned within the interior 82. The ejection mechanism 70 is adapted to releasably couple the applicator pad 22 to the frame 26.

Figure 6:
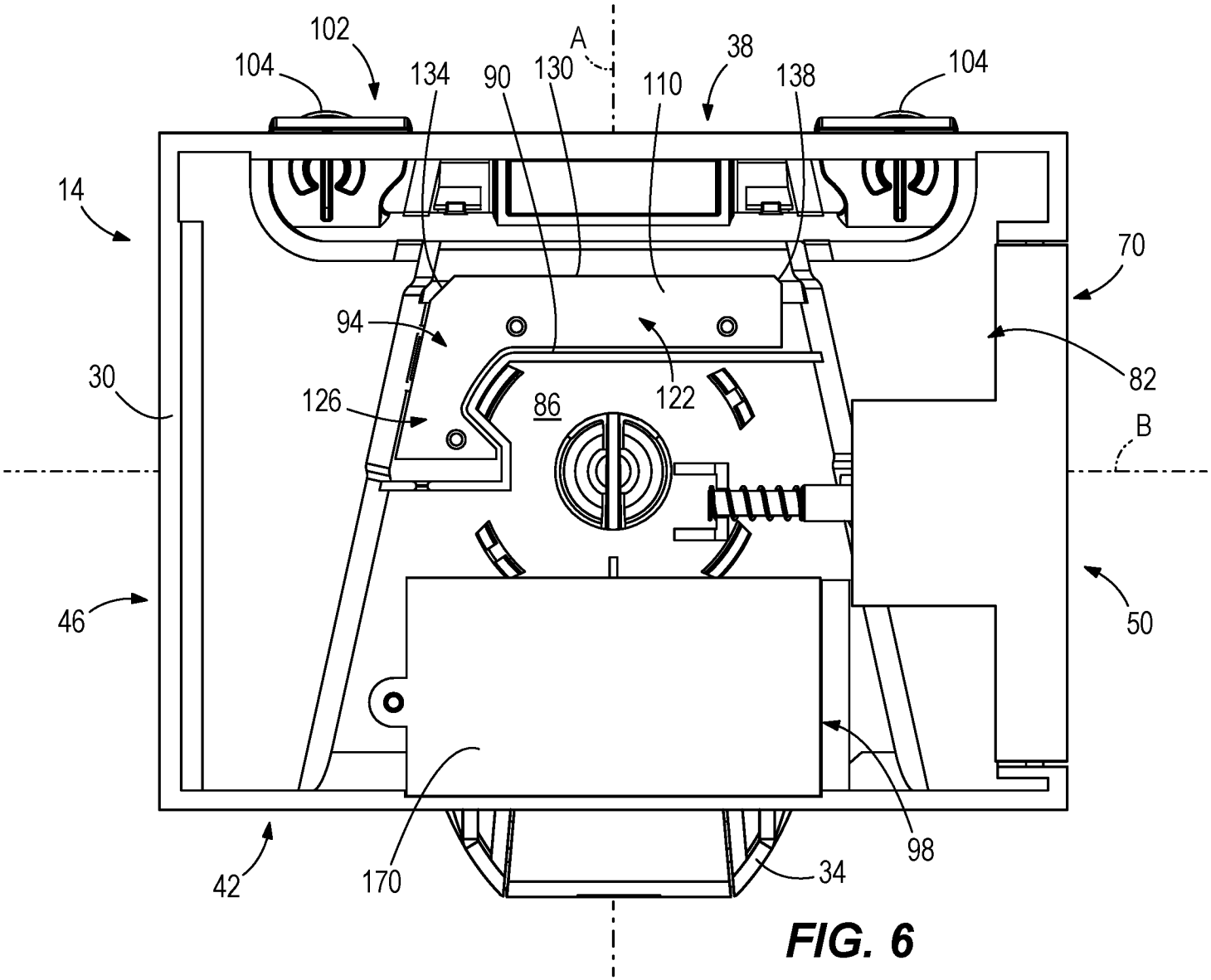
FIG. 6 is a bottom view of the paint applicator assembly of FIG. 5 without the applicator pad.
Figure 7:
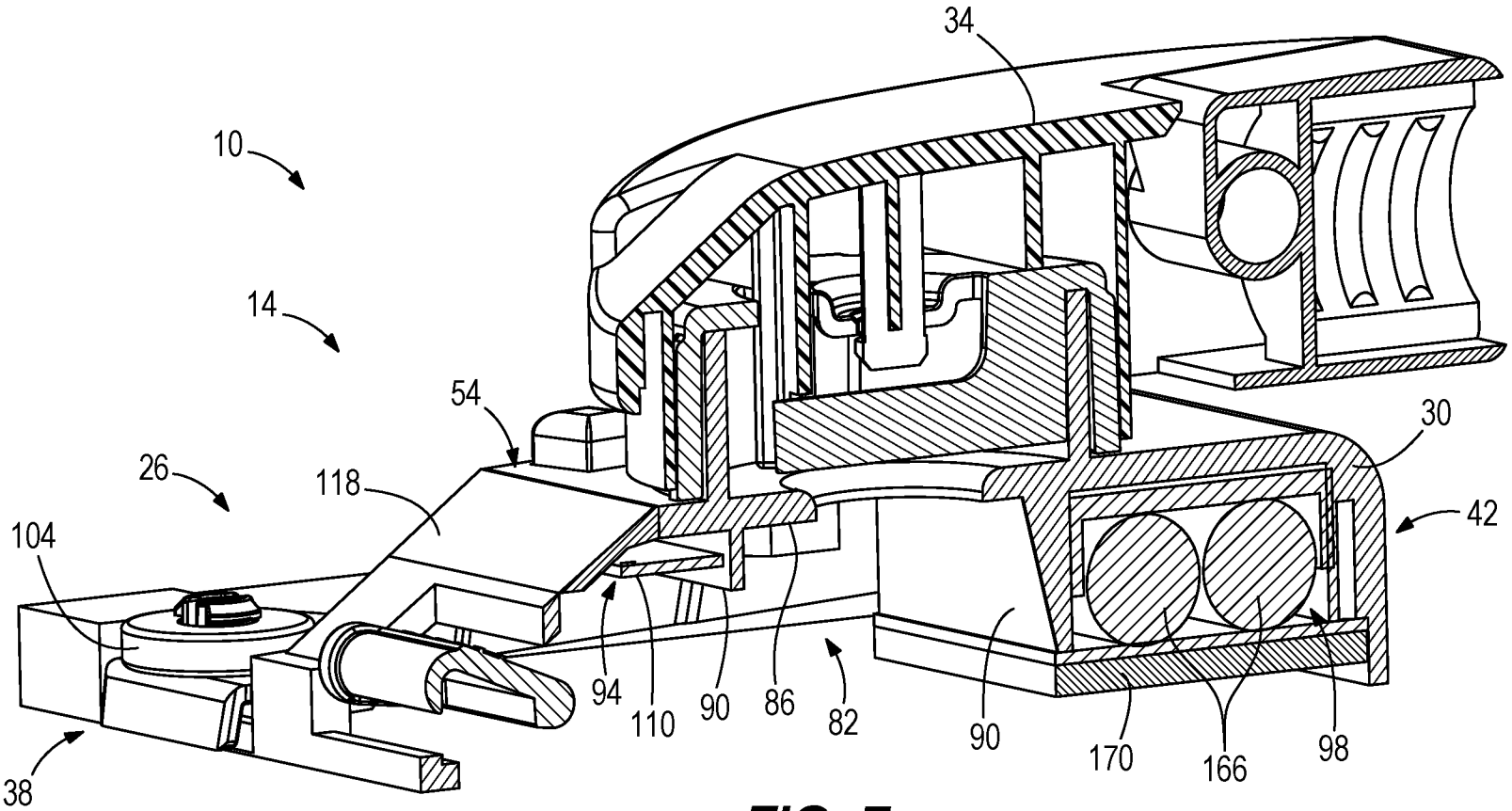
FIG. 7 is a cross-sectional view of the paint applicator assembly of FIG. 1.

With reference to FIGS. 6 and 7, the base 30 includes a plurality of inner surfaces 86 to define the interior 82. In addition, the base 30 includes a plurality of interior walls 90 positioned within the interior 82. Each interior wall 90 extends from one of the inner surfaces 86 of the base 30. The interior walls 90 separate the interior 82 into a first interior compartment 94 and a second interior compartment 98, as further discussed below. The first interior compartment 94 is positioned proximate the forward side 38, and the second interior compartment 98 is positioned proximate the rear side 42 of the base 30.

The base 30 of the frame 26 further includes a guide assembly 102 (FIG. 1) positioned adjacent the forward side 38. The illustrated guide assembly 102 includes two wheels 104. The wheels 104 allow the paint applicator assembly 10 to transverse across a painting surface smoothly. In other embodiments, the guide assembly 102 may include fewer or more wheels, or may include other suitable mechanisms for guiding the paint applicator assembly 10 along a surface.

Figure 3:
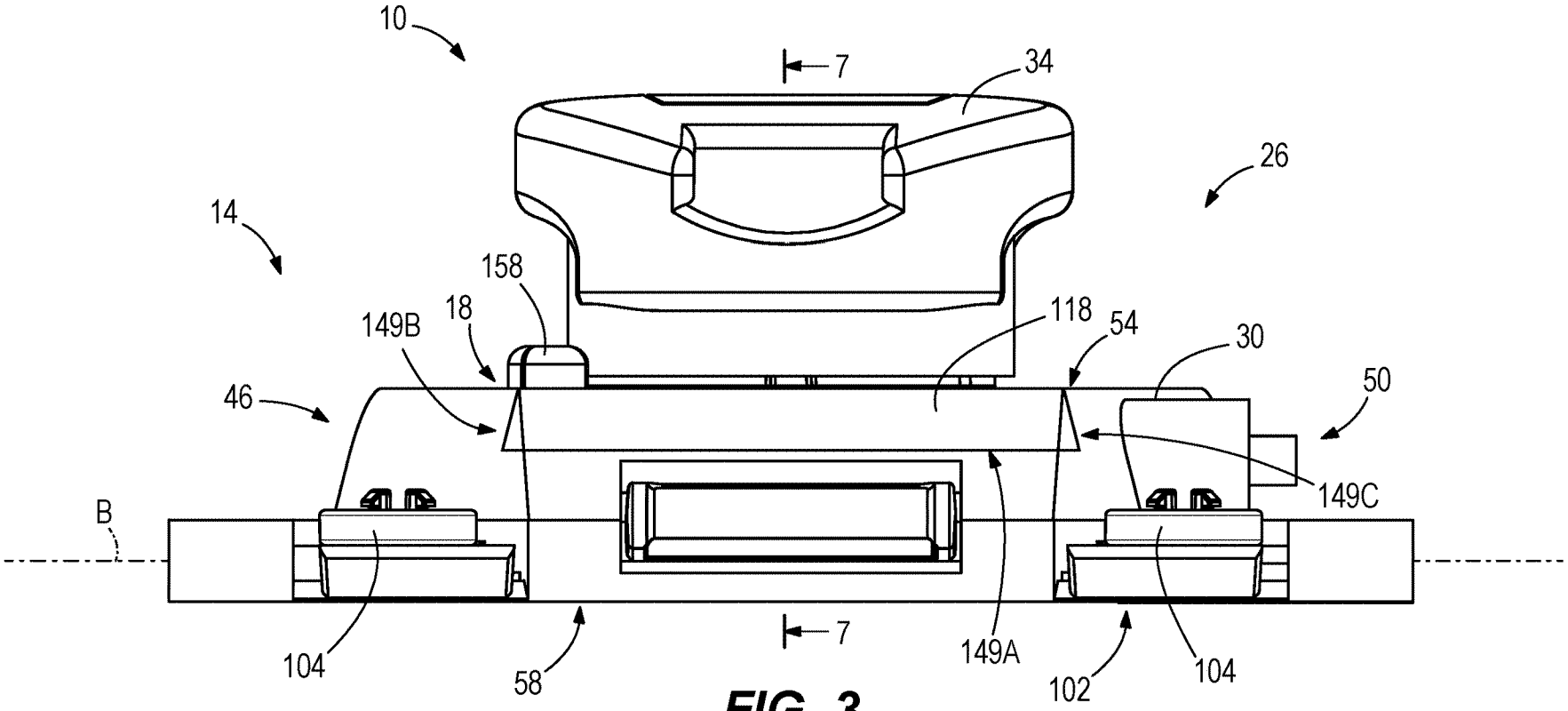
FIG. 3 is a front view of the paint applicator assembly of FIG. 1.
Figure 4:
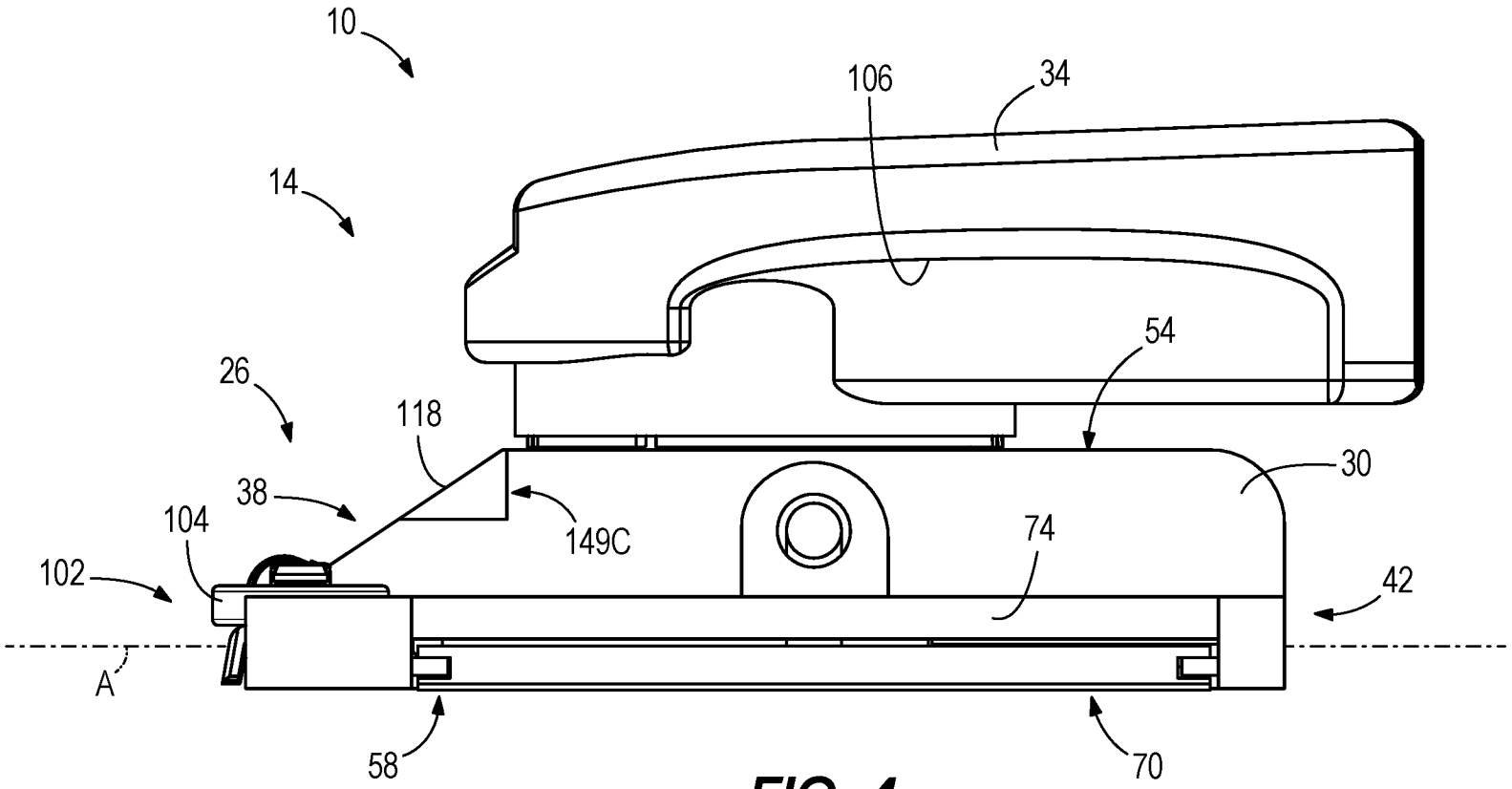
FIG. 4 is a side view of the paint applicator assembly of FIG. 1.

With reference to FIGS. 3-4, the turret 34 extends from the top side 54 of the base 30 and may be grasped by the hand of a user to increase the control during a painting operation. The turret 34, or handle, includes indents 106 (FIG. 4) to improve the ergonomic grip for a user.

With reference to FIGS. 5-7, the light assembly 18 is supported by the frame 26. The light assembly 18 includes a print circuit board (PCB) 110, a plurality of light sources 114A-E, and a lens member 118. The first interior compartment 94 is configured to receive the light assembly 18. As shown in FIG. 6, the illustrated PCB 110 is shaped to compliment the shape of the first interior compartment 94. The PCB 110 includes a forward side portion 122 and a lateral portion 126 extending therefrom.

Figure 8:
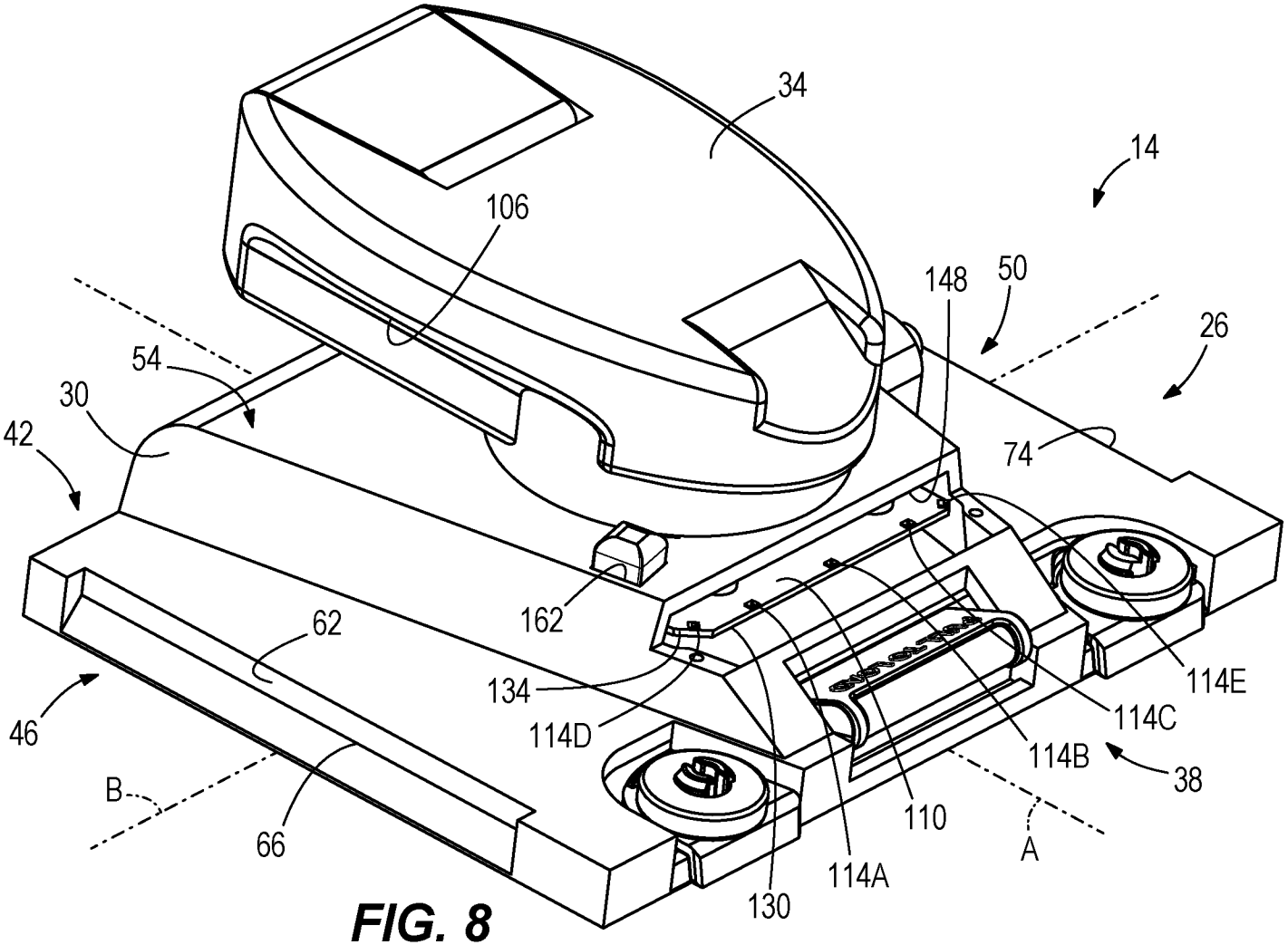
FIG. 8 is a front perspective view of the paint applicator assembly of FIG. 1 with portions removed, and illustrating a printed circuit board positioned within the paint applicator assembly.
Figure 9:
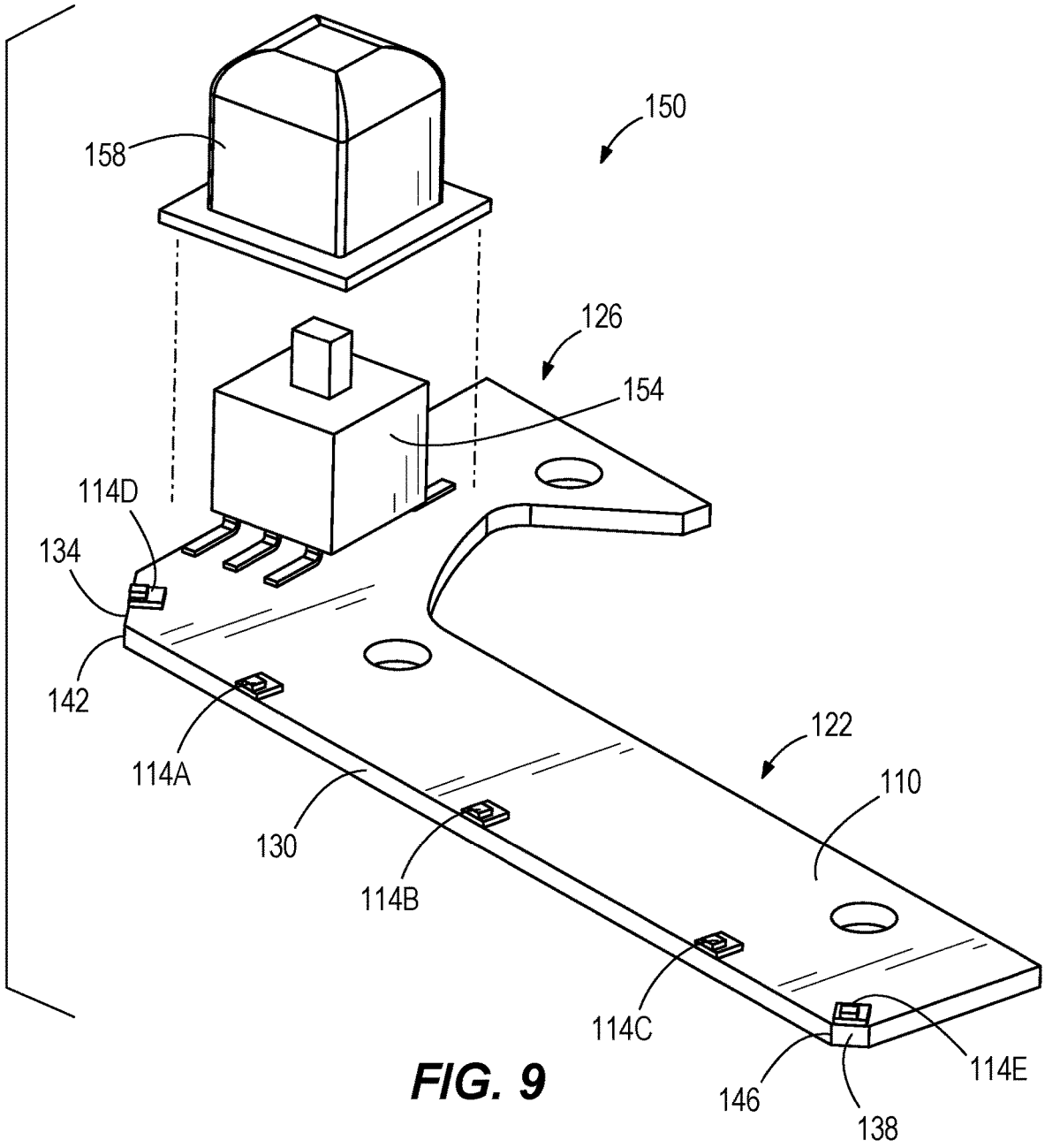
FIG. 9 is an exploded view of the printed circuit board including a plurality of LEDs and a switch assembly supported on the printed circuit board.
Figure 10:
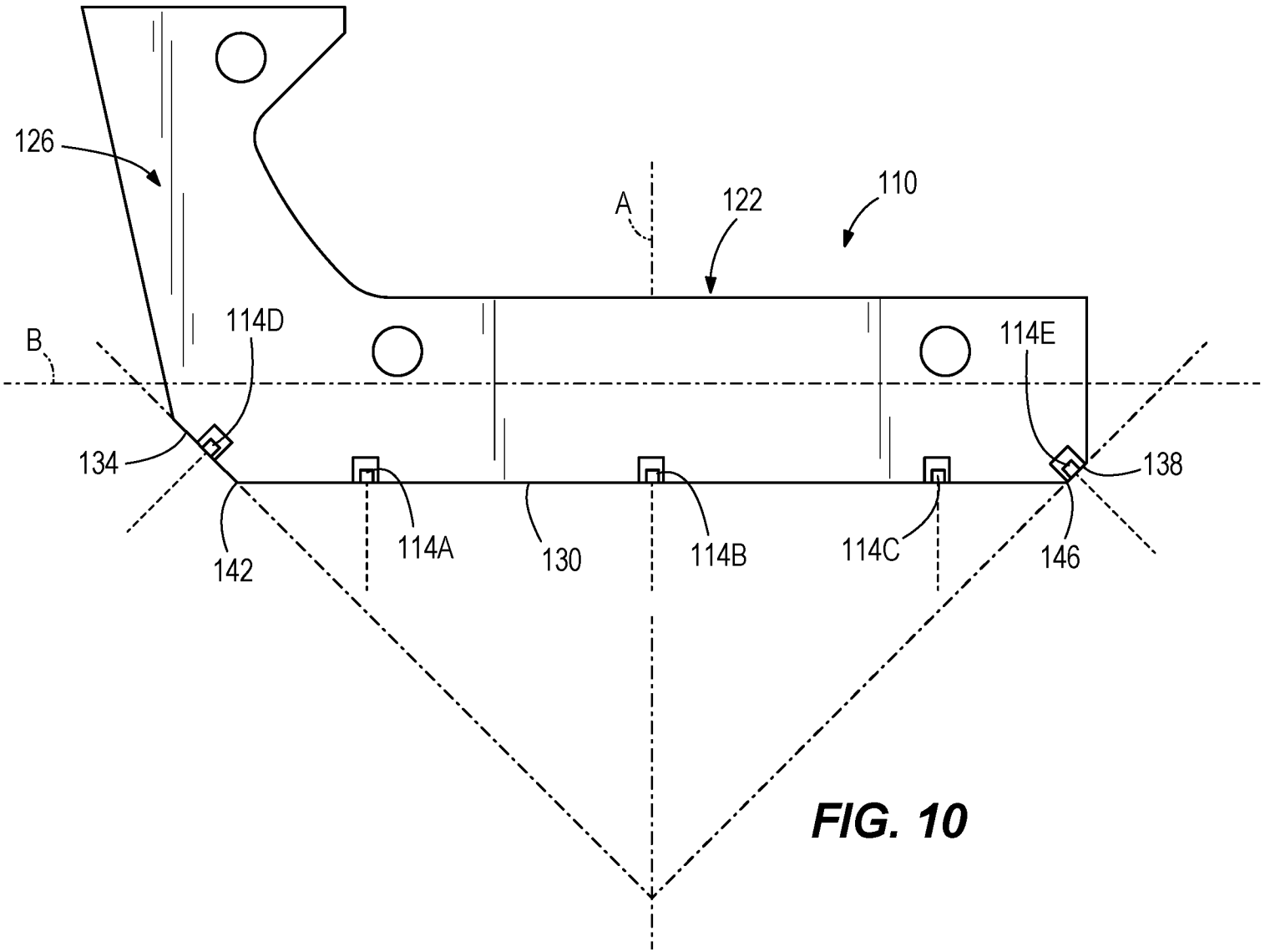
FIG. 10 is a top view of the printed circuit board of FIG. 9.

With reference to FIGS. 8-10, the PCB 110 includes a plurality of edges 130, 134, 138. In particular, the forward side portion 122 of the PCB 110 includes a first, forward edge 130 extending parallel with the lateral axis B. The forward edge 130 extends between a first end 142 and a second, opposite end 146. The forward edge 130 is positioned proximate the forward side 38 of the base 30.

The forward side portion 122 of the PCB 110 also includes second and third, side edges 134, 138 extending from the first and second ends 142, 146, respectively, of the forward edge 130. Each of the second and third side edges 134, 138 extends at an oblique angle relative to the longitudinal axis A and the lateral axis B of the base 30. The second and third side edges 134, 138 are positioned proximate the first and second lateral sides 46, 50, respectively, of the base 30.

The light sources 114A-E are supported by the PCB 110. The light sources 114A-E are positioned on the forward side portion 122 of the PCB 110. In addition, the light sources 114A-E are positioned adjacent one of the plurality of edges 130, 134, 138. In the illustrated embodiment, the plurality of light sources 114A-E includes five light sources 114A-E in which three of the light sources 114A-C are positioned adjacent the forward edge 130, and the remaining two light sources 114D, 114E are positioned adjacent one of the second side edge 134 and the third side edge 138. In other embodiments, the light assembly 18 may include one or more light sources 114A-E positioned on any portion (e.g., lateral portion 126, etc.), and also adjacent any one of the plurality of edges 130, 134, 138 of the PCB 110. In further other embodiments, the one or more of the light sources 114A-E may be spaced from one or more of the plurality of edges 130, 134, 138.

With specific reference to FIG. 8, each light source 114A-E is a light emitting diode (LED). Each light source 114A-E is configured to direct light outward from at least one of the forward side 38, the first lateral side 46, and the second lateral side 50 of the base 30. For example, the light sources 114A-C are positioned to direct light outward from the forward side 38. In addition, the light sources 114D, 114E are positioned to direct light outward from the first lateral side 46 and the second lateral side 50, respectively.

Furthermore, with reference to FIG. 10, each light source 114A-E is configured to direct light along a direction. In the illustrated embodiment, each light source 114A-E is positioned relative to one of the edges 130, 134, 138 such that each light source 114A-E is configured to direct light along the direction that is normal to the respective edge 130, 134, 138. For example, the light sources 114A-C are positioned adjacent the forward edge 130 such that each light source 114A-C is configured to direct light in a direction normal to the forward edge 130 (and also in a direction parallel with the longitudinal axis A, and perpendicular to the lateral axis B). In addition, the light sources 114D, 114E are positioned adjacent the second side edge 134 and third side edge 138, respectively, such that each light source 114D, 114E is configured to direct light in a direction normal to the second side edge 134 and the third side edge 138, respectively. As such, each of the light sources 114D, 114E is configured to direct light in a direction at an oblique angle relative to the longitudinal and lateral axes A, B. The light sources 114A-C are configured to direct light in a direction that is different than the direction of light of the remaining light sources 114D, 114E.

With reference to FIGS. 3 and 8, the base 30 defines an elongated cutout 148. In particular, the elongated cutout 148 is positioned on the forward side 38 of the base 30. Furthermore, the elongated cutout 148 is positioned partially on the first lateral side 46 and the second lateral side 50 of the base 30. The elongated cutout 148 may be further positioned on other sides of the base 30 (e.g., top side 54). The elongated cutout 148 is a continuous cutout. In other words, the elongated cutout 148 is not interrupted by portions of the base 30.

The lens member 118 of the light assembly 18 is supported by the base 30. In addition, the lens member 118 is received in the elongated cutout 148. As such, the lens member 118 extends across the forward side 38, and extends partially across the first lateral side 46 and the second lateral side 50. In other words, the lens member 118 includes a first portion 149A positioned on the forward side 38, a second portion 149B positioned on the first lateral side 46, and a third portion 149C positioned on the second lateral side 50. Accordingly, the lens member 118 wraps around the base 30 from the first lateral side 46, across the forward side 38, and to the second lateral side 50. In some embodiments, the lens member 118 may wrap around the first lateral side 38 and only one of the lateral sides 46, 50.

The first, second, and third portions 149A-C of the lens member 118 are positioned proximate the forward edge 130, the first side edge 134, and second side edge 138, respectively, of the PCB 110. The lens member 118 is configured as a single piece, and is formed of transparent material. The lens member 118 covers the plurality of light sources 114A-E.

With reference to FIGS. 1, 8, and 9, the light assembly 18 further includes a switch assembly 150. The switch assembly 150 includes a switch 154 and an actuator 158. The switch 154 is supported by the PCB 110. The illustrated switch 154 is positioned on the lateral portion 126 of the PCB 110. The switch 154 is electrically connected to the plurality of light sources 114A-E.

The actuator 158 is operatively coupled to the switch 154. The base 30 defines an opening 162 (FIG. 8) on the top side 54 of the base 30. The PCB 110 is positioned within the first interior compartment 94 and proximate the top side 54 of the base 30 such that the switch 154 is positioned within the first interior compartment 194, and the actuator 158 extends through the opening 162 in the base 30. The actuator 158 is partially exposed to an exterior of the base 30. The actuator 158 is engageable by a user for adjusting the switch assembly 150 between an on state and an off state. In the illustrated embodiment, the actuator 158 includes a pushbutton. In other embodiments, other suitable actuators may be used (e.g., a dial, a slider, etc.). In addition, in some embodiments, the actuator 158 may also cycle between different modes (e.g., high, low, etc.) of the light assembly 18, or the light assembly 18 may include a second actuator for changing modes. In further embodiments, the light assembly 18 may cycle between different modes where only subsets of the light sources 114A-E are turned on (e.g., the light sources 114A, 114D, and 114E are turned on; the light sources 114B, 114C, and 114E are turned on; all of the light sources 114A-E are turned on etc.).

With reference to FIGS. 5-7, the second interior compartment 98 is configured to removably receive a power source. In the illustrated embodiment, the power source includes a plurality of batteries 166 (FIG. 7). The batteries 166 are electrically connected to the PCB 110. The batteries 166 are configured to supply power to the plurality of light sources 114A-E. A door member 170 is releasably coupled (e.g., by a screw) to one of the interior walls 90. The door member 170 selectively encloses the second interior compartment 98.

The switch assembly 150 is configured to selectively control a power supply from the batteries 166 to the plurality of light sources 114A-E. As such, the switch assembly 150 is configured to selectively control the illumination of the light assembly 18.

In operation, a user may actuate the actuator 158 to turn the light assembly 18 on. The light assembly 18 may help illuminate relatively dark areas, such as corners and small spaces. By providing light sources 114A-E that are aimed in different directions, the area around the paint applicator assembly 10 is better illuminated, rather than only illuminating the area directly in front of the paint applicator assembly 10.

Various features and advantages of the invention are set forth in the following claims.

What is claimed is:

1. A paint applicator assembly comprising:

a frame including a base having a forward linear side, a rear side, a first lateral side, and a second lateral side opposite the first lateral side, the base defining a longitudinal axis extending through the forward side and the rear side, and a lateral axis extending through the first lateral side and the second lateral side;

one or more wheels coupled to the frame adjacent the forward linear side; and a light assembly supported by the frame, spaced from the forward linear side, and positioned behind the wheels, the light assembly including a printed circuit board including a forward side portion positioned proximate the forward side of the base, the forward side portion having a forward edge extending parallel with the lateral axis and a side edge extending at an oblique angle relative to the longitudinal axis and the lateral axis, and a plurality of light sources supported on the printed circuit board, the plurality of light sources including a first light source and a second light source positioned on the forward side portion, wherein the first light source is configured to direct light along a first direction that is normal to the forward edge of the printed circuit board, and the second light source is configured to direct light along a second direction that is normal to the side edge of the printed circuit board.

2. The paint applicator assembly of claim 1, wherein the first direction of the first light source is parallel with the longitudinal axis.

3. The paint applicator assembly of claim 2, wherein the second direction of the second light source is at an angle relative to the longitudinal axis.

4. The paint applicator assembly of claim 1, further comprising a lens member supported by the frame, the lens member configured to cover each of the plurality of light sources.

5. The paint applicator assembly of claim 1, wherein the side edge is a first side edge, and wherein the forward side portion of the printed circuit board includes a second side edge extending at an angle from the forward edge.

6. The paint application assembly of claim 5, wherein the plurality of light sources further includes a third light source positioned adjacent the second side edge, and wherein the third light source is configured to direct light along a third direction that is different than the first and second directions.

7. The paint applicator assembly of claim 5, wherein the forward edge is positioned adjacent the forward side, wherein the first side edge is positioned adjacent the first lateral side, and wherein the second side edge is positioned adjacent the second lateral side.

8. The paint applicator assembly of claim 1, further comprising a paint applicator pad releasably couplable to the frame.

9. A paint applicator assembly comprising:

a frame including a base having a forward side, a first lateral side, and a second lateral side opposite the first lateral side; and a light assembly supported by the frame, the light assembly including a plurality of light sources supported by the frame, the plurality of light sources including a first light source, a second light source, and a third light source, wherein the first light source is configured to direct light outward from the forward side of the base, the second light source is configured to direct light outward from the first lateral side of the base, and the third light source is configured to direct light outward from the second lateral side of the base, and a single, continuous lens member configured to cover the plurality of light sources, the single, continuous lens member spaced from the forward side, the first lateral side, and the second lateral side and wrapping around the base from the first lateral side, across the forward side, and to the second lateral side.

10. The paint applicator assembly of claim 9, wherein the base defines a longitudinal axis extending through the forward side and a rear side opposite the forward side, and wherein the first light source is configured to direct light in a first direction parallel with the longitudinal axis, wherein the second light source is configured to direct light in a second direction at an angle relative to the longitudinal axis, and wherein the third light source is configured to direct light in a third direction at an angle relative to the longitudinal axis.

11. The paint applicator assembly of claim 9, further comprising a printed circuit board including a forward side portion positioned proximate the forward side of the base, wherein each of the plurality of light sources is positioned on the printed circuit board.

12. The paint applicator assembly of claim 11, wherein the forward side portion of the printed circuit board includes a first edge, and a second edge and a third edge extending at an angle therefrom, and wherein the first light source is positioned adjacent the first edge, the second light source is positioned adjacent the second edge, and the third light source is positioned adjacent the third edge.

13. The paint applicator assembly of claim 12, wherein the first edge is positioned adjacent the forward side, wherein the second edge is positioned adjacent the first lateral side, and wherein the third edge is positioned adjacent the second lateral side.

14. A paint applicator assembly comprising:

a frame including a base having a forward side, a first lateral side, a second lateral side opposite the first lateral side, a top side, and a bottom side, the bottom side opposite the top side, the bottom side configured to support a paint applicator pad; and a light assembly supported by the frame, the light assembly including a printed circuit board including a forward side portion and a lateral portion, the forward side portion positioned proximate the forward side of the base, the lateral portion extending from the forward side portion away from the forward side of the base, one or more light sources supported on the printed circuit board, a lens member supported by the frame and configured to cover the one or more light sources, the lens member extending across the forward side and at least portions of the first lateral side and the second lateral side of the base, and a switch positioned on the lateral portion of the printed circuit board, the switch being accessible through the top side of the base to control operation of the one or more light sources.

15. The paint applicator assembly of claim 14, wherein the base defines an elongated cutout positioned on the forward side, and at least partially on the first lateral side and the second lateral side, and wherein the lens member is received in the elongated cutout.

16. The paint applicator assembly of claim 14, wherein the one or more light sources includes a first light source and a second light source, wherein the first light source is positioned to direct light through a first portion of the lens member located on the forward side, and wherein the second light source is positioned to direct light through a second portion of the lens member located on the first lateral side.

17. The paint applicator assembly of claim 14, wherein the forward side portion of the printed circuit board includes a first edge, a second edge extending at an angle from the first edge, and a third edge extending at an angle from the first edge, wherein the lens member includes a first portion, a second portion, and a third portion, and wherein the first portion of the lens member is positioned on the forward side and adjacent the first edge, the second portion is positioned on the first lateral side and adjacent the second edge, and the third portion is positioned on the second lateral side and adjacent the third edge.

18. The paint applicator assembly of claim 17, wherein the one or more light sources includes a first light source, a second light source, and a third light source, and wherein the first light source is positioned adjacent the first edge, the second light source is positioned adjacent the second edge, and the third light source is positioned adjacent the third edge.

* * * * *